US005603563A

United States Patent [19]

Natsume

[11] Patent Number: 5,603,563

[45] Date of Patent: Feb. 18, 1997

[54] VEHICULAR LAMP HAVING GLITTERING APPEARANCE

[75] Inventor: Kazunori Natsume, Shizuoka, Japan

[73] Assignee: Koito Manufacturing Co., Ltd., Tokyo, Japan

[21] Appl. No.: 360,956

[22] Filed: Dec. 21, 1994

[30] Foreign Application Priority Data

Dec. 21, 1993 [JP] Japan ..... 5-072916 U
Jul. 22, 1994 [JP] Japan ..... 6-170670

[51] Int. Cl.[6] ..... F21V 7/00

[52] U.S. Cl. ..... 362/309; 362/61; 362/332; 362/336

[58] Field of Search ..... 362/308, 309, 362/335, 336, 61, 332, 338

[56] References Cited

U.S. PATENT DOCUMENTS 1,689,911 10/1928 Broughton ..... 362/336 X
2,137,079 11/1938 Falge ..... 362/336

*Primary Examiner*—Stephen F. Husar
*Attorney, Agent, or Firm*—Sughrue, Mion, Zinn, Macpeak & Seas

[57] ABSTRACT

The front opening of a lamp body with a bulb attached thereto is covered with a lens. The lens includes a plural number of areas having horizonal and vertical cylindrical steps formed thereon. The areas including the horizonal cylindrical steps and the areas including the vertical cylindrical steps are alternately disposed.

7 Claims, 2 Drawing Sheets

VEHICULAR LAMP HAVING GLITTERING APPEARANCE

BACKGROUND OF THE INVENTION

The present invention relates to a vehicular lamp and, more particularly, the invention provides a vehicular lamp having an improved outer lens which causes the lamp to have a glittering appearance.

In a conventional vehicular lamp, fisheye steps are often formed on an outer lens to distribute vertical and horizontal light passing therethrough. However, the conventional vehicular lamp with fisheye steps formed over the entire surface of the lens presents a flat look overall, which is not attractive.

SUMMARY OF THE INVENTION

The present invention was made in view of the foregoing disadvantages accompanying conventional vehicular lamps. Accordingly, an object of the invention is to provide a vehicular lamp having an outer lens capable of making the lamp present a glittering appearance.

The above and other objects can be achieved by the provision of a vehicular lamp which, according to the present invention, has an outer lens covering a front opening of a lamp body, the outer lens being provided with a plurality of sectional areas each having cylindrical steps formed therein, the cylindrical steps of adjacent areas being axially oriented orthogonal to each other.

In the vehicular lamp thus constructed having two types of cylindrical steps of which the axial directions are oriented orthogonal to each other, a number of focal lines are created extending in directions orthogonal to each other. These focal lines cause the lamp to have a glittering appearance.

DESCRIPTION OF THE PREFERRED EMBODIMENTS

Figure 1:
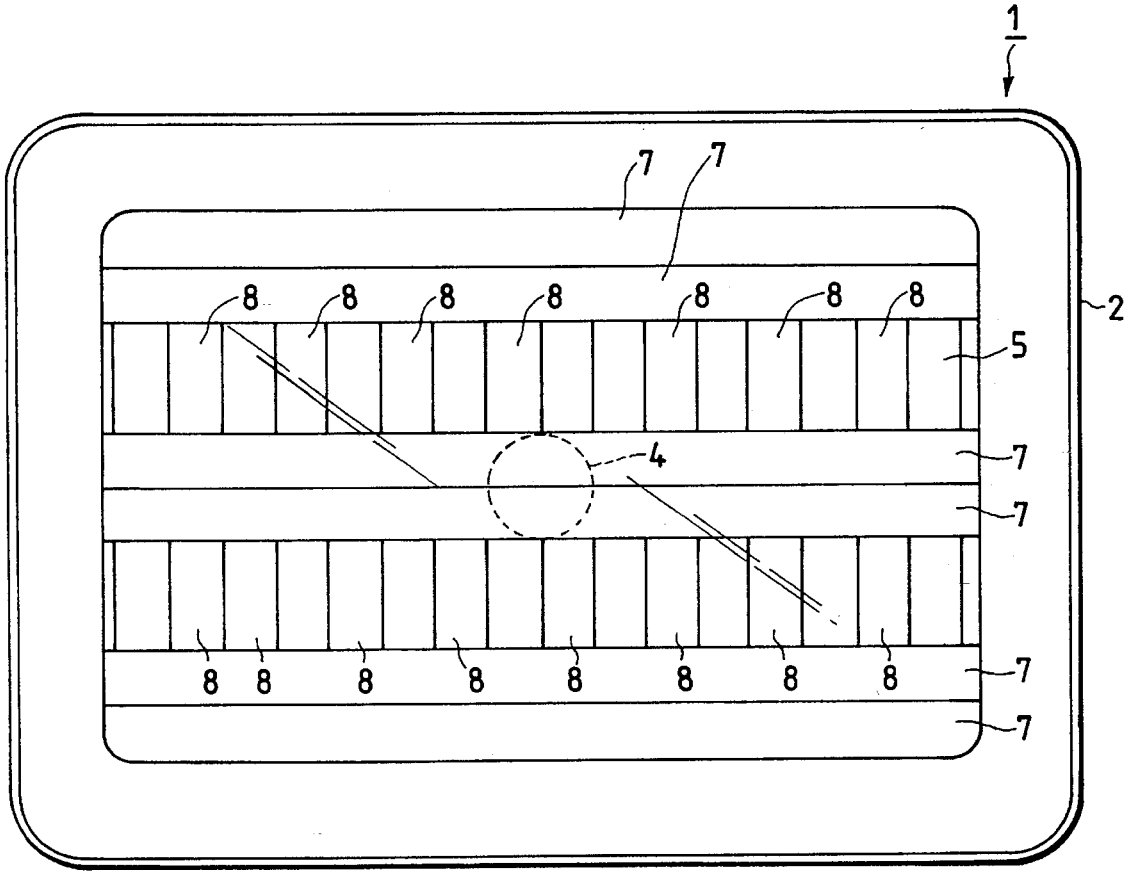
FIG. 1 is a front view showing an embodiment of an identification (marker) lamp for vehicles constructed according to the present invention.
Figure 2:
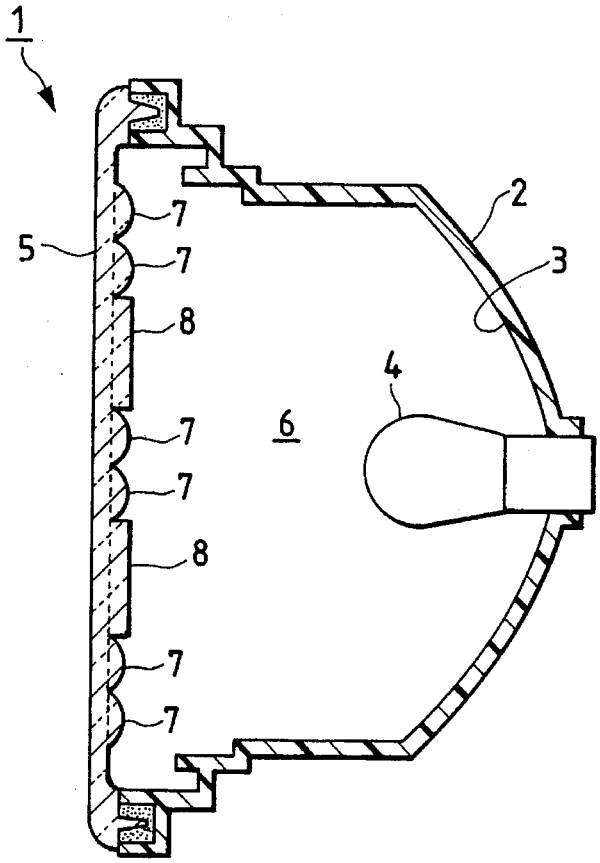
FIG. 2 is a vertical sectional view of the identification lamp.
Figure 3:
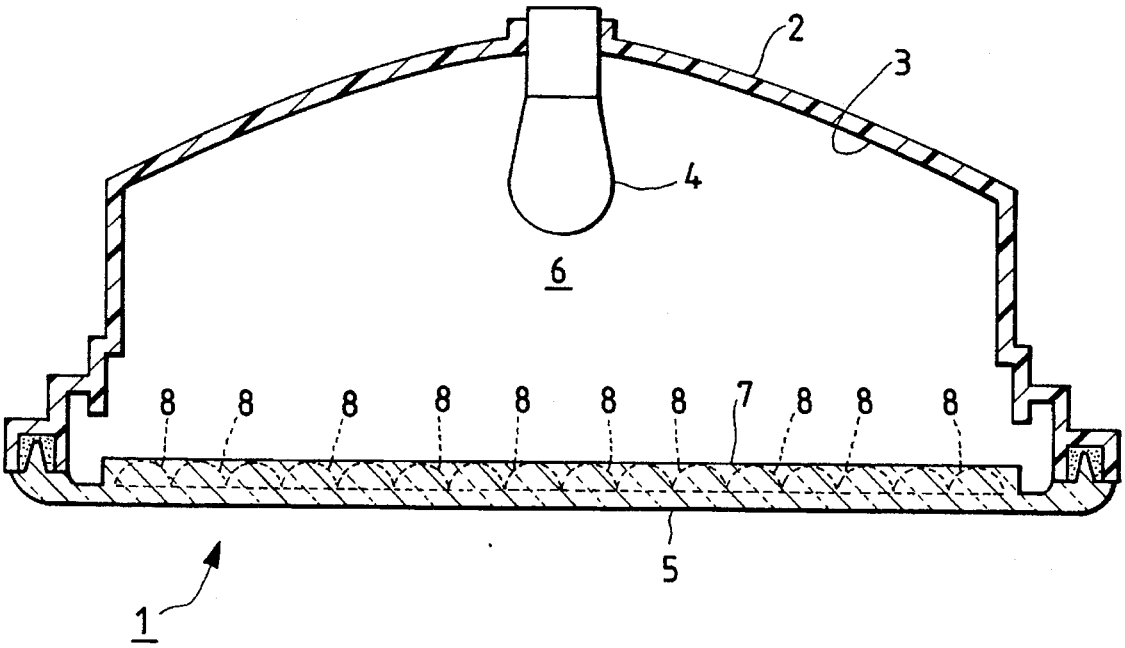
FIG. 3 is a horizontal sectional view of the identification lamp.

Preferred embodiments of a vehicular lamp according to the present invention will be described with reference to the accompanying drawings. The present invention is embodied in the form of a marker lamp 1 for motor vehicles.

The marker lamp 1 is provided with a lamp body 2 made of synthetic resin. The lamp body 2 is cup-shaped having a front opening. The inner surface 3 of the lamp body 2 is coated with a reflective coating to serve as the reflector of the lamp. A bulb 4 is disposed at the center part of the rear portion of the lamp body 2.

An outer lens made of a transparent synthetic resin is attached to the lamp body 2 such that the front opening of the lamp body 2 is covered with the outer lens 5. A lamp space 6 is defined by the lamp body 2 and the outer lens 5.

The surface of the outer lens 5 is segmented into five sectional areas. Horizonal cylindrical steps 7 extending horizontally are formed on the rear surface of the three sectional areas, i.e., the top, bottom, and middle sectional areas. Vertical cylindrical steps 8 are formed on the rear surface of the second sectional areas as counted from the top and the bottom of the lens. In the marker lamp 1 thus constructed, the focal lines of the horizonal cylindrical steps 7 and the vertical cylindrical steps 8, which are alternately formed, are orthogonal to each other. This arrangement causes the lamp to present a glittering appearance.

The two types of steps, i.e., the horizonal and vertical cylindrical steps 7 and 8, may be designed such that the radius of curvature of the first type of the cylindrical steps (7) is different from that of the second type of the cylindrical steps (8), for example, the radius of curvature of the former may be larger than that of the latter. By so doing, when viewing the identification lamp, one sees the glittering reflecting surface 3 through the horizonal cylindrical steps 7, and the glittering vertical cylindrical steps 8. As a result, the identification lamp provides an appearance of depth.

As seen from the foregoing description, in the identification lamp for vehicles according to the present invention, the outer lens covers a front opening of a lamp body in which a light source is disposed, and the outer lens includes a plurality of sectional areas each composed of cylindrical steps, the cylindrical steps of the adjacent areas being axially oriented orthogonal to each other.

In the marker lamp thus constructed, by the provision of the two types of cylindrical steps whose axial directions are oriented orthogonal to each other, a number of focal lines are presented extending in directions orthogonal to each other. These focal lines cause the lamp to have a glittering appearance.

It should be understood that the form of the invention herein shown and described is to be taken as a preferred example of the invention and that various changes in the shape, size and arrangement of parts may be resorted to without departing from the spirit of the invention or the scope of the subjoined claims. For example, it is evident that the number of areas having cylindrical steps formed therein and the directions of the cylindrical steps formed therein may be varied. Also, the direction of the cylindrical steps may be inclined with respect to the lamp, and they may be arranged in a crosshatched pattern.

What is claimed is:

1. A marker vehicular lamp comprising:

a cup-shaped lamp body having a reflector and a front opening;

a light source mounted at a center portion of said lamp body; and an outer lens covering said front opening of said lamp body, said outer lens having a plurality of sectional areas on a common surface each area having formed thereon one of first cylindrical steps oriented in a first direction and second cylindrical steps oriented in a second direction, said first direction and said second direction being orthogonal to each other.

2. The vehicular lamp of claim 1, wherein said first cylindrical steps comprise horizontal cylindrical steps, a longitudinal axis of which is oriented horizontally, and said second cylindrical steps comprise vertical cylindrical steps, a longitudinal axis of which is oriented vertically.

3. The vehicular lamp of claim 1, wherein said outer lens has a five sectional areas arranged in a vertical direction of said lens, said first cylindrical steps being formed in first, third and fifth sections from a top one of said sectional areas, and said second cylindrical steps being formed in second and fourth sections.

4. The vehicular lamp of claim 1, wherein a radius of curvature of said first cylindrical steps is larger than that of said second cylindrical steps.

5. The vehicular lamp of claim 1, wherein a radius of curvature of said first cylindrical steps is smaller than that of said second cylindrical steps.

6. The vehicular lamp of claim 1, wherein said outer lens is made of a transparent synthetic resin.

7. The vehicular lamp of claim 1, wherein said outer lens has a five sectional areas arranged in a horizontal direction of said lens, said first cylindrical steps being formed in first, third and fifth sections from a leftmost one of said sectional areas, and said second cylindrical steps being formed in second and fourth sections.

* * * * *